US005879183A

United States Patent [19]

Okabe

[11] Patent Number: 5,879,183

[45] Date of Patent: Mar. 9, 1999

[54] PRESS-CONNECTING TERMINAL

[75] Inventor: Toshiaki Okabe, Shizuoka, Japan

[73] Assignee: Yazaki Corporation, Tokyo, Japan

[21] Appl. No.: 14,049

[22] Filed: Jan. 27, 1998

[30] Foreign Application Priority Data

Feb. 7, 1997 [JP] Japan ..... 9-025379

[51] Int. Cl.[6] ..... H01R 4/24

[52] U.S. Cl. ..... 439/397

[58] Field of Search ..... 439/397, 399, 439/400, 406, 407

[56] References Cited

U.S. PATENT DOCUMENTS

| | | | |
|---|---|---|---|
| 4,291,935 | 9/1981 | Badoz et al. | 439/399 |
| 4,806,120 | 2/1989 | Baker | 439/399 |
| 4,940,425 | 7/1990 | Hass et al. | 439/397 |
| 5,554,046 | 9/1996 | Sugiyama et al. | 439/397 |

FOREIGN PATENT DOCUMENTS 51-127487 11/1976 Japan .

*Primary Examiner*—Neil Abrams
*Assistant Examiner*—Barry M. L. Standig
*Attorney, Agent, or Firm*—Sughrue, Mion, Zinn, Macpeak & Seas, PLLC

[57] ABSTRACT

A press-connecting terminal has a press-connecting portion in which even when a covered electric wire having an external diameter equal to or greater than the inside width between a pair of sidewalls is pressed into a space between the pair of sidewalls, the pair of sidewalls are prevented from being widened outward. The press-connecting terminal is such that recessed portions for receiving a covering portion of the covered electric wire pressed into a gap between press-connecting blades are provided in the respective inside surfaces of the pair of sidewalls. Therefore, the restoring force of the covering portion acting as what widens the sidewalls outward is eased.

4 Claims, 4 Drawing Sheets

PRESS-CONNECTING TERMINAL

BACKGROUND OF THE INVENTION

1. Field of the Invention

The present invention relates to a press-connecting terminal which is electrically connected to a covered electric wire by pressing the covered electric wire into a gap between press-connecting blades formed on a pair of sidewalls.

2. Description of the Related Art

FIG. 4 shows a conventional press-connecting terminal 1. The press-connecting terminal 1 incorporates a contact portion 2 which is formed on one side of the terminal and to be connected to a mating terminal, and an electric wire joint 3 which is formed on the other side thereof and to be connected to the end of an electric wire. The electric wire joint 3 is provided with an electric-wire holding portion 4 for holding the electric wire on the rear side of the electric wire joint 3. Further, a press-connecting portions 5 is formed between the electric-wire holding portion 4 and the contact portion 2.

The press-connecting portion 5 comprises a bottom wall 6, a pair of sidewalls 7, 7 which are respectively bent upward in the substantially perpendicular direction from both sides of the bottom wall 6, and at least a pair of press-connecting blades 8, 8 which are bent so that these blades stand up from the respective sidewalls 7, 7 above the bottom wall 6 and face each other with a predetermined gap held therebetween. The press-connecting terminal shown in FIG. 4 has three pairs of press-connecting blades 8, 8.

The end portion of a covered electric wire 9 is pressed into a gap between the pair of press-connecting blades 8, 8 so as to rupture a covering portion (see FIG. 5) 10 of the covered electric wire 9 by means of the press-connecting blades 8, 8. When a conductor portion (see FIG. 5) 11 is brought into contact with the press-connecting blades 8, 8 the covered electric wire 9 and the press-connecting terminal 1 are electrically connected to each other. Incidentally, the covered electric wire 9 is clamped by the electric-wire holding portion 4 and held in the press-connecting terminal 1.

With tendencies for the size of housings of, for example, connectors to be reduced and for the density of terminals to be increased, there has developed a demand for reducing the size of such a press-connecting terminal 1 in order to decrease a storage space in the housing.

Thereupon, an attempt may be made to narrow the width of the press-connecting portion 5 as shown in FIG. 5 by setting the inside width L1 between the pair of sidewalls 7, 7 where the press-connecting blades 8, 8 are formed to be smaller than the external diameter L2 of the covered electric wire 9 in the press-connecting portion 5 to which the end portion of the covered electric wire 9 is press-connected.

When a covered electric wire 9 having an external diameter L2 equal to or greater than the inside width L1 between the pair of sidewalls 7, 7 is pressed into the gap between the press-connecting blades 8, 8 as shown in FIG. 6, however, the pair of sidewalls 7, 7 tend to widen outward due to the restoring force of the covered electric wire 9 during and after the press-fitting operation.

When the pair of sidewalls 7, 7 widen outward, there is the possibility that the contact load between the press-connecting blades 8, 8 and the conductor portion 11 of the covered electric wire 9 lowers, thus making the normal contact therebetween unobtainable.

SUMMARY OF THE INVENTION

An object of the present invention is to provide a press-connecting terminal having a press-connecting portion whose pair of sidewalls never widen outward even when a covered electric wire having thickness equal to or greater than the inside width between the pair of sidewalls of the press-connecting terminal.

In order to accomplish the above object, according to the present invention, there is provided a press-connecting terminal comprising a press-connecting portion comprising: a bottom wall; a pair of sidewalls which are respectively bent upward in a substantially perpendicular direction from both sides of the bottom wall; a pair of press-connecting blades which are respectively bent so that the blades stand up from the pair of sidewalls above the bottom wall and face each other with a predetermined gap held therebetween, a covered electric wire being to be pressed into a gap between the press-connecting blades and the covered electric wire having an external diameter greater than an inside width between the pair of sidewalls; and a pair of recessed portions respectively formed in inside surfaces of the pair of sidewalls for receiving a covering portion of the covered electric wire which is pressed into the gap between the press-connecting blades.

BRIEF DESCRIPTION OF THE DRAWINGS

FIG. 2(*b*) is a sectional view of the same, showing a state after the covered electric wire has been pressed into the press-connecting terminal.

DETAILED DESCRIPTION OF THE PREFERRED EMBODIMENTS

Figure 1:
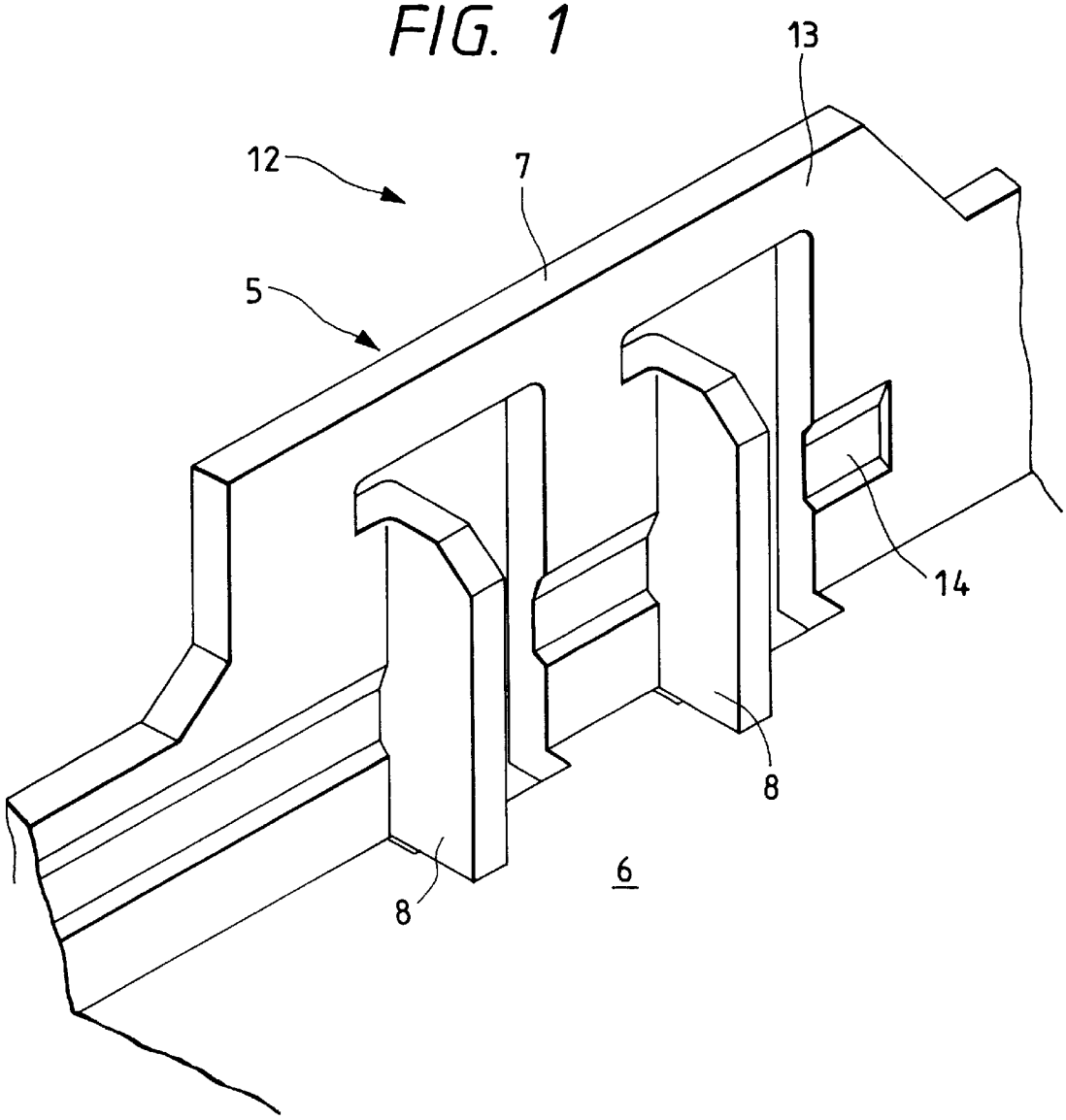
FIG. 1 is a perspective view of a press-connecting terminal embodying the present invention with a partial illustration of the sidewall of the press-connecting terminal.
Figure 2A:
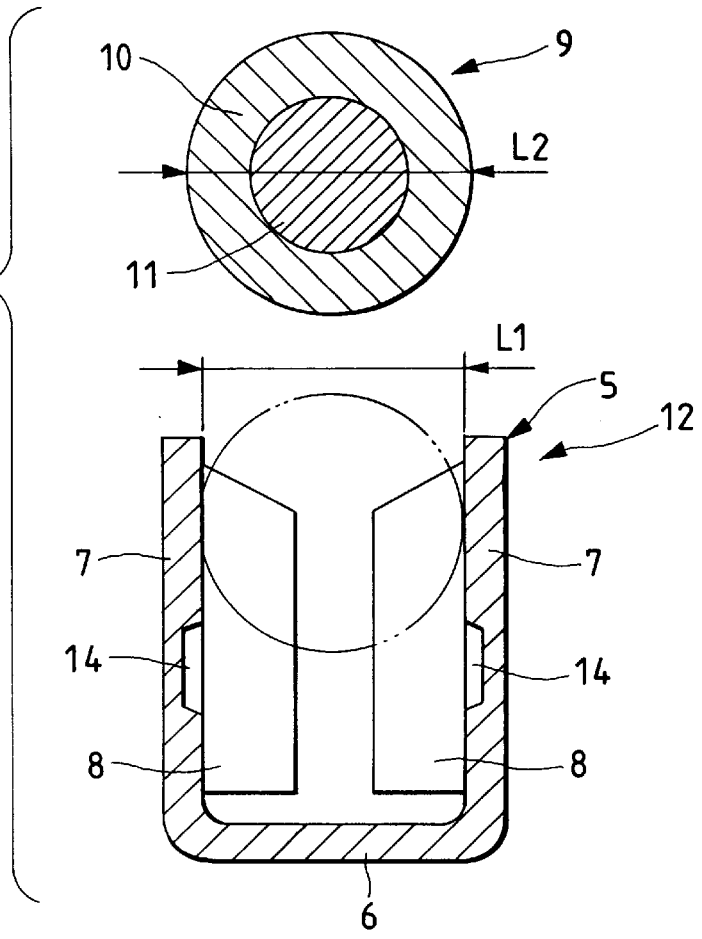
FIG. 2(*a*) is a sectional view of the press-connecting terminal according to the embodiment and a covered electric wire to be press-connected to the terminal, showing a state before the covered electric wire is pressed into the press-connecting terminal.
Figure 2B:
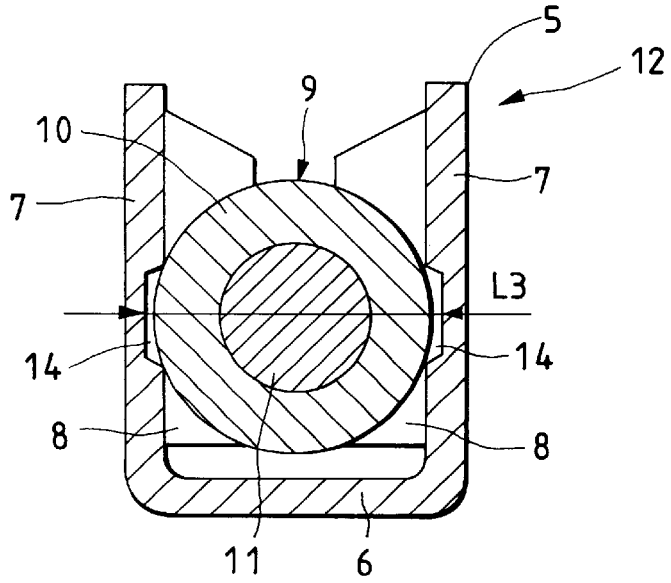
Figure 4:
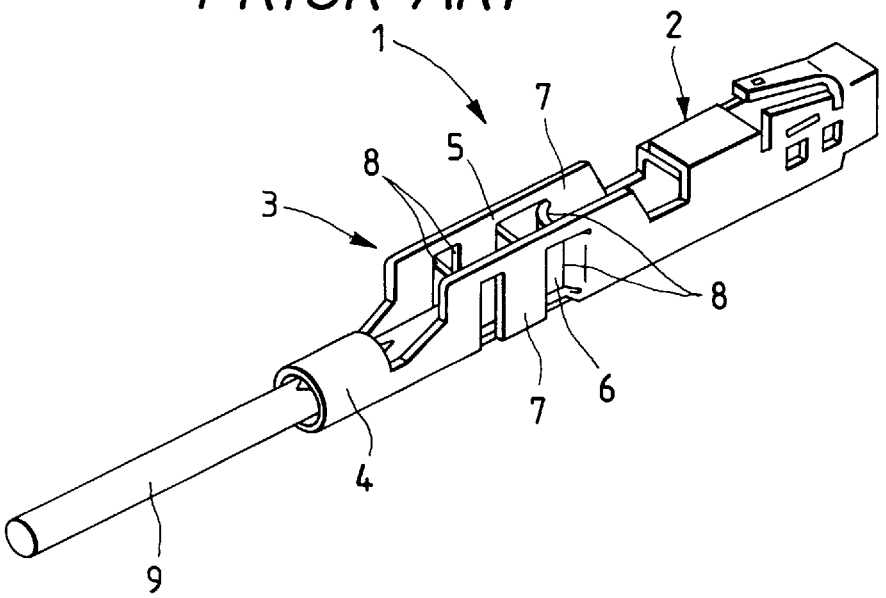
FIG. 4 PRIOR ART
FIG. 4 is a perspective view of a conventional press-connecting terminal and a covered electric wire which has been press-connected to the press-connecting terminal.
Figure 5:
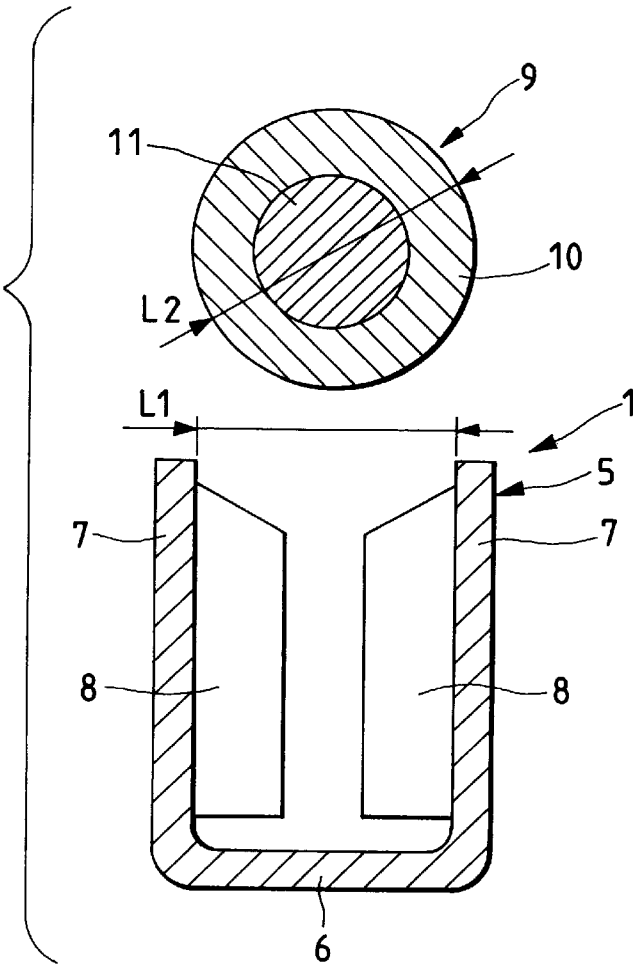
FIG. 5 PRIOR ART
FIG. 5 is a sectional view showing the relation between the conventional press-connecting terminal and the covered electric wire.
Figure 6:
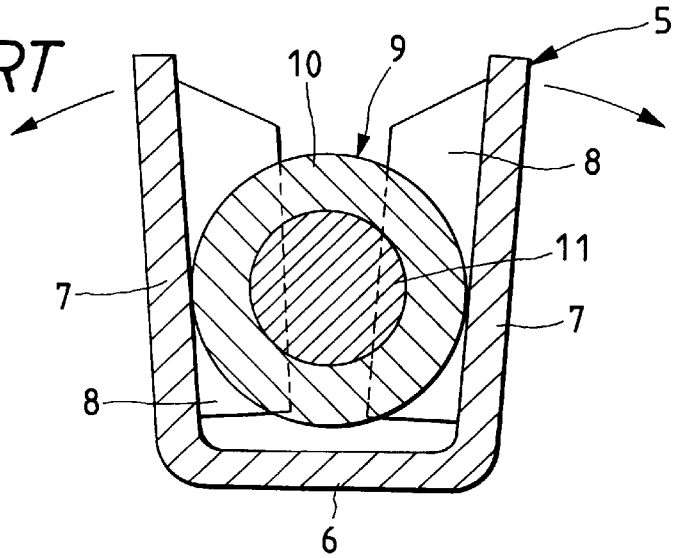
FIG. 6 PRIOR ART
FIG. 6 is a sectional view showing a state in which the covered electric wire is pressed into the conventional press-connecting terminal.

A press-connecting terminal embodying the present invention will subsequently be described. FIG. 1 shows part of a sidewall 7 of a press-connecting terminal 12 according to the present embodiment. FIG. 2(*a*) is a sectional view showing a state before a covered electric wire 9 is pressed into the press-connecting terminal 12; and FIG. 2(*b*) is a sectional view showing a state after the covered electric wire 9 has been pressed into the press-connecting terminal 12, wherein like reference characters are given to like component parts as those of the press-connecting terminal shown in FIG. 4 and the description thereof will be omitted.

As shown in FIG. 1, the press-connecting terminal 12 according to the present embodiment is structured so that recessed portions 14, 14 for receiving a covering portion 10 of the covered electric wire 9 pressed into a gap between press-connecting blades 8, 8 are formed in respective inside surfaces 13 of a pair of sidewalls 7, 7 (however, only one sidewall is shown in FIG. 1) of a press-connecting portion 5, that is, formed long along the axial direction of the covered electric wire 9 and close to a bottom wall 6 in the height direction of the sidewalls 7, 7.

As shown in FIGS. 2(*a*) and 2(*b*), moreover, the width L3 between the recessed portions 14, 14 of the pair of sidewalls 7, 7 is set to be equal to or greater than the external diameter of the covered electric wire 9, whereas the inside width L1 between the pair of sidewalls 7, 7 is set to be equal to or smaller than the external diameter L2 of the covered electric wire 9. In other words, the width L3 between the recessed portions 14, 14 and the inside width L1 between the sidewalls 7, 7 with respect to the external diameter L2 are set at $L1 \leqq L2 \leqq L3$.

Referring to FIGS. 2(*a*) and 2(*b*), there is subsequently given a description of a process for connecting the end portion of the covered electric wire 9 to the press-connecting terminal 12.

The covered electric wire 9 is set in register with the pair of sidewalls 7, 7 of the press-connecting terminal 12 first and then pressed into the space between the pair of sidewalls 7, 7 by means of a press-fitting jig or the like toward the bottom wall 6. The covered electric wire 9 thus pressed into the space between the pair of sidewalls 7, 7 is processed so that the portion brought into contact with the press-connecting blades 8, 8 is cut out and the portion which has not been brought into contact therewith is inserted in between the sidewalls 7, 7 in such a state that it has become vertically-long deformed as shown by a two-dotted chain line in FIG. 2(*a*).

When the covered electric wire 9 is further pressed into the space between the sidewalls 7, 7, the press-connecting blades 8, 8 and a conductor portion 11 exposed as a result of the rupture of the covering portion 10 are brought into contact with each other and electrically connected. Part of the covering portion 10 that has not been ruptured is further inserted into the space between the sidewalls 7, 7 and both sides thereof are forced into the respective recessed portions 14, 14.

In this case, the vertically-long deformed state may be immediately restored to the original state after the covered electric wire 9 is pressed into the space between the sidewalls 7, 7 and both sides of the covering portion 10 may enter the respective recessed portions 14, 14 as shown in FIG. 2(*b*). Alternately, after the deformed state is otherwise gradually restored to the original state as time elapses, both sides of the covering portion 10 may also enter the respective recessed portions 14, 14.

In any one of the above cases, both sides of the covering portion 10 enter the respective recessed portions 14, 14 and thus, the force of causing the covering portion 10 to widen the pair of sidewalls 7, 7 outward is eased.

In the press-connecting terminal 12 according to this embodiment of the present invention, since both sides of the covered electric wire 9 thus pressed into the space between the sidewalls 7, 7 are forced into the respective recessed portions 14, 14 as shown in FIG. 2(*b*), the force of causing the covering portion 10 to widen the sidewalls 7, 7 outward is eased, so that the sidewalls 7, 7 are prevented from being widened outward. Consequently, the press-connecting blades 8, 8 and the conductor portion 11 are brought into contact with each other at a normal contact load, whereby highly reliable electrical connection is obtainable.

As both sides of the covering portion 10 of the covered electric wire 9 press-connected to the press-connecting portion 5 are forced into the respective recessed portions 14, 14 according to this embodiment of the present invention, the covered electric wire 9 can be set in vertical registration with the press-connecting terminal 12, and the press-connecting blades 8, 8 can be brought into normal contact with the conductor portion 11, whereby highly reliable electrical connection is obtainable as well.

In the press-connecting terminal 12 according to this embodiment of the present invention, further, since both sides of the covering portion 10 are forced into the respective recessed portions 14, 14, the covered electric wire 9 is prevented from unexpectedly slipping out of the space between the sidewalls 7, 7 even though external force is inadvertently applied to the covered electric wire 9; in other words, the press-connecting terminal has the effect of preventing the electric wire from slipping out.

Since the inside width L1 between the sidewalls 7, 7 can be set not to be greater than the external diameter of the covered electric wire 9 to be press-connected according to this embodiment of the present invention, the width of the press-connecting portion 5 can be reduced, so that the size and density of the press-connecting terminal 12 can be improved.

Although the width L3 between the recessed portions 14, 14 has been set to be equal to or greater than the external diameter L2 of the covered electric wire 9, the invention is not limited to the above-described embodiment thereof but may be applicable to a case where the width L3 between the recessed portions 14, 14 is smaller than the external diameter L2 of the covered electric wire 9. In this case, the space between the recessed portions 14, 14 may be at least wide enough to prevent the restoring force of the covered electric wire 9 from widening the pair of sidewalls 7, 7 outward.

Figure 3:
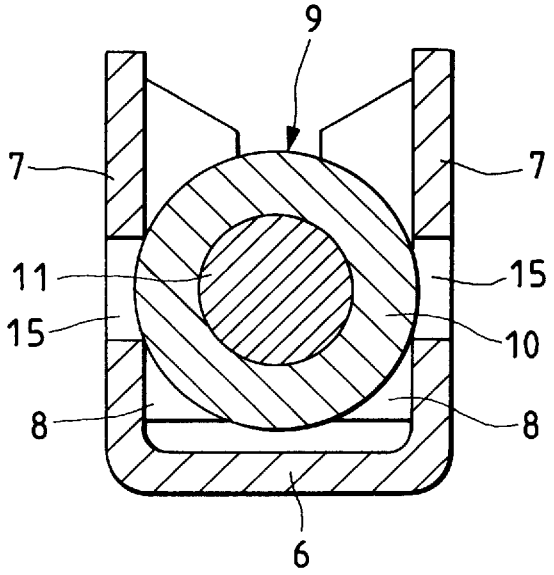
FIG. 3 is a sectional view of another press-connecting terminal embodying the present invention and a covered electric wire.

Referring to FIG. 3, there is given a description of another press-connecting terminal embodying the present invention. In this embodiment of the invention, recessed portions are respectively provided in the pair of sidewalls 7, 7 and in the form of a through-hole (hole portion) 15 communicating the inside of each sidewall with the outside thereof.

Also in this embodiment, both sides of a covering portion 10 are forced into the respective openings of the hole portions 15, 15 when a covered electric wire 9 is pressed into a space between the sidewalls 7, 7, whereby the restoring force of the covering portion 10 of the covered electric wire 9 is eased.

When a press-connecting terminal 12 is formed, the same effect as what is achievable according to the preceding embodiment of the invention is obtainable and in addition, the production of the press-connecting terminal is facilitated because the recessed portions are made formable by only punching the through-holes and the production cost can be reduced accordingly.

It is also possible to easily confirm whether the covered electric wire 9 has been press-connected to the proper position of a press-connecting portion 5 by looking in between the sidewalls 7, 7 from the outside of the hole portions 15, 15.

As described above, according to the present invention, the recessed portions for receiving the covering portion of the covered electric wire pressed into the gap between the press-connecting blades are provided in the respective inside surfaces of the pair of sidewalls so as to force the covering portion of the covered electric wire into the respective recessed portions of the pair of sidewalls. Thus, the force of causing the covering portion of the covered electric wire to press the pair of sidewalls outward is eased since the covering portion is forced into the recessed portions, and the pair of sidewalls are prevented from being widened outward.

What is claimed is:

1. A press-connecting terminal comprising a press-connecting portion comprising:

a bottom wall;

a pair of sidewalls which are respectively bent upward in a substantially perpendicular direction from both sides of said bottom wall;

a pair of press-connecting blades which are respectively bent so that said blades stand up from said pair of sidewalls above said bottom wall and face each other with a predetermined gap held therebetween, a covered electric wire being to be pressed into a gap between said press-connecting blades and the covered electric wire having an external diameter greater than an inside width between said pair of sidewalls; and a pair of recessed portions respectively formed in inside surfaces of said pair of sidewalls for receiving a covering portion of the covered electric wire which is pressed into the gap between said press-connecting blades.

2. The press-connecting terminal as claimed in claim 1, wherein said recessed portions in said pair of sidewalls are in the form of a through-hole communicating with an inside of each sidewall with an outside thereof.

3. The press-connecting terminal as claimed in claim 1, wherein the inside width between said pair of sidewalls is smaller than the external diameter of the covered electric wire, and a width between said recessed portions of said pair of sidewalls is greater than the external diameter of the covered electric wire.

4. The press-connecting terminal as claimed in claim 1, wherein said recessed portions are formed long along an axial direction of the covered electric wire to be pressed into the gap between said press-connecting blades.

* * * * *